US008939179B2

(12) United States Patent
Janicijevic et al.

(10) Patent No.: US 8,939,179 B2
(45) Date of Patent: Jan. 27, 2015

(54) WEAVING MACHINE HAVING MOVABLE SHED OPENING LIMITER DEVICE

(75) Inventors: Dirk Janicijevic, Lindau (DE); Johannes Louven, Lindau (DE); Hubert Ortmann, Heimenkirch (DE); Kurt Motz, Lindau (DE); Thomas Laukamp, Lindau (DE); Michael Langer, Hergensweiler (DE); Herbert Mueller, Pineville, NC (US)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 13/980,120

(22) PCT Filed: Dec. 22, 2011

(86) PCT No.: PCT/EP2011/073784

§ 371 (c)(1),
(2), (4) Date: Sep. 10, 2013

(87) PCT Pub. No.: WO2012/100888

PCT Pub. Date: Aug. 2, 2012

(65) Prior Publication Data

US 2013/0333791 A1 Dec. 19, 2013

(30) Foreign Application Priority Data

Jan. 28, 2011 (DE) ..... 10 2011 009 765

(51) Int. Cl.
*D03D 51/00* (2006.01)
*D03D 41/00* (2006.01)
(Continued)

(52) U.S. Cl.
CPC ..... *D03D 41/00* (2013.01); *D03C 13/00* (2013.01); *D03D 41/008* (2013.01); *D03J 1/22* (2013.01)
USPC ..... 139/434; 139/55.1; 139/35; 139/1 E; 139/116.1

(58) Field of Classification Search
CPC .... D03D 39/223; D03D 47/267; D03D 51/02
See application file for complete search history.

(56) References Cited

U.S. PATENT DOCUMENTS 2,938,547 A * 5/1960 Dewas ..... 139/35
3,796,384 A * 3/1974 Rosen ..... 242/364.5
(Continued)

FOREIGN PATENT DOCUMENTS

JP 2000-096387 A 4/2000
JP 2003-253547 A 9/2003

OTHER PUBLICATIONS

International Search Report of the International Searching Authority for International Application PCT/EP2011/073784, mailed Mar. 28, 2013, 2 pages, European Patent Office, HV Rijswijk, Netherlands.
(Continued)

*Primary Examiner* — Bobby Muromoto, Jr.
(74) *Attorney, Agent, or Firm* — W. F. Fasse

(57) ABSTRACT

A weaving machine for producing a woven fabric has a shedding device to form a loom shed of warp material, a weft insertion device for inserting a preferably tape-shaped or band-shaped weft material into the loom shed, a drawing-off device for drawing off the finished fabric in a drawing-off direction, fabric movement device for moving the fabric back and forth in the warp direction to bring the last inserted weft material into contact with the binding point or fabric edge. A shed limiter device limits the opening of the loom shed from above and below the warp, and is movable back and forth in the warp direction. The shed limiter device only loosely bounds the fabric and essentially without actively clamping or pinching or contacting the fabric and/or the last inserted weft material, at least while moving in the direction opposite the drawing-off direction.

20 Claims, 6 Drawing Sheets

(51) Int. Cl.

| | |
|---|---|
| ***D03C 13/00*** | (2006.01) |
| ***D03J 1/22*** | (2006.01) |
| *D03D 49/00* | (2006.01) |

(56) References Cited

U.S. PATENT DOCUMENTS

| | | | | | |
|---|---|---|---|---|---|
| 4,248,272 | A | * | 2/1981 | Wilson et al. | 139/353 |
| 4,485,848 | A | * | 12/1984 | Eisenlohr | 139/25 |
| 4,554,950 | A | * | 11/1985 | Sancini et al. | 139/25 |
| 4,815,504 | A | * | 3/1989 | Linka | 139/436 |
| 4,837,485 | A | * | 6/1989 | Meroth et al. | 318/161 |
| 5,099,890 | A | * | 3/1992 | Duetsch et al. | 139/25 |
| 5,649,570 | A | * | 7/1997 | Wahhoud et al. | 139/291 C |
| 5,783,278 | A | | 7/1998 | Nishimura et al. | |
| 5,803,135 | A | * | 9/1998 | Wahhoud et al. | 139/434 |
| 6,240,975 | B1 | * | 6/2001 | Hehle et al. | 139/434 |

OTHER PUBLICATIONS

PCT International Preliminary Report on Patentability including English Translation of PCT Written Opinion of the International Searching Authority for International Application PCT/EP2011/073784, issued Jul. 30, 2013, 8 pages, International Bureau of WIPO, Geneva, Switzerland.

* cited by examiner

WEAVING MACHINE HAVING MOVABLE SHED OPENING LIMITER DEVICE

FIELD OF THE INVENTION

The present invention relates to a weaving machine or loom for producing a woven fabric with shedding means for alternately raising and lowering warp material for forming a loom shed, with weft insertion means that are arranged stationarily in the warp direction in a weft insertion position for inserting a preferably band-shaped or tape-shaped weft material into the loom shed, as well as with drawing-off means or take-off means for drawing off the finished woven fabric or material in a drawing-off or take-off direction. Furthermore, means for the fabric or material movement in the warp direction are provided, by means of which the fabric edge is movable in a fabric or material movement range, back and forth between a downstream initial position and an upstream collecting or pick-up position, in order to bring the respective last-inserted weft material into contact with the fabric edge in the collecting or pick-up position.

BACKGROUND INFORMATION

In the state of the art, a plurality of different solutions have already been presented for the individual steps in the weaving process such as, for example, the shed formation, the weft insertion and beat-up, as well as the fabric take-off, or respectively the corresponding structural assemblies. For producing woven fabrics of band-shaped or tape-shaped materials, the known solutions are, however, largely not suitable. Thus, with band-shaped materials or materials containing reinforcement fibers, which comprise a lower flexibility than typical conventional thread-shaped materials, it can lead to deformations caused by handling devices of the weaving machine, and as a result to damages of the band or tape material. With band-shaped weft materials, due to their width, it can lead to a wave formation in the weft direction, which makes it more difficult to form flat woven fabrics. Also, with use of band-shaped materials as weft material, a typical conventional weft beat-up by means of a weaving reed is not possible, because this would give rise to damages and deformations on the band-shaped weft material. On the other hand, without a weft beat-up, it is not possible to produce a uniform dense or tight woven fabric.

Thus, the JP 2003-253547 A1 suggests to use a woven fabric motion instead of a typical conventional weft beat-up for the woven fabric formation. For this, a roller pair is provided, between which the fabric edge of the already produced woven fabric is clamped. After the weft insertion, the roller pair with the clamped fabric edge is moved contrary to the drawing-off or take-off direction up to the newly inserted weft material, in order to bring it into contact with the fabric edge of the woven fabric. By rotation of the rollers, the last inserted weft material comes between the two rollers of the roller pair and is clamped by these. Next, the roller pair with the newly formed clamped fabric edge is again moved back into the initial position. Because the clamping of the original fabric edge is released during the rotation of the rollers for the clamping of the last inserted weft material, in this case also, it can still give rise to gaps in the woven fabric or an insufficient weft density or weft set. Furthermore, it can lead to damages of the weft material caused by the rollers.

SUMMARY OF THE INVENTION

In view of the above it is an object of one or more embodiments of the present invention to propose a weaving machine that reduces the danger of damages of the weft material and especially a band-shaped or tape-shaped weft material. The invention further aims to avoid or overcome the disadvantages of the prior art, and to achieve additional advantages, as apparent from the present specification. The attainment of these objects is, however, not a required limitation of the claimed invention.

The above objects have been achieved in one or more embodiments of the weaving machine or loom according to the invention as disclosed herein.

A weaving machine or loom for producing a woven fabric includes shedding means for alternately raising and lowering warp material for forming a loom shed, weft insertion means arranged stationarily in a warp direction in a weft insertion zone for inserting a preferably band-shaped or tape-shaped weft material, as well as drawing-off means or take-off means for drawing-off the finished material or woven fabric in a drawing-off direction. In this regard, the weft insertion zone is defined by the stationarily arranged weft insertion means or the front and rear edge of a just-inserted band-shaped weft material. Furthermore, means for fabric movement in the warp direction are provided, by means of which the fabric edge is movable in a fabric movement range back and forth between a downstream initial position and an upstream collecting or pick-up position, in order to bring the respective last inserted weft material into contact with the fabric edge in the pick-up position and to achieve a fabric formation. In the scope of the present application, the terms upstream and downstream respectively relate to the drawing-off or take-off direction, so that correspondingly the downstream initial position is located closer to the fabric draw-off means than the upstream pick-up position.

Furthermore, according to an embodiment of the invention, upper and lower limiting means that are movable in the warp direction are provided, which limit the opening of the loom shed effectuated by the shedding means, and which are movable within a limiting means movement range back and forth between an upstream and a downstream end position. The fabric or the warp material is guided through between the upper and lower limiting means in the direction toward the drawing-off means. In this regard, the limiting means are movable without clamping or pinching, that is without active impinging contact, over the fabric and/or a last inserted weft material, at least during the movement contrary to the drawing-off direction. Thus, the limiting means surround the last inserted weft material or the fabric only loosely, so that they protect the weft material against undesired deformations in an especially gentle or careful manner.

In a method for producing a woven fabric on a weaving machine, in which a loom shed is formed by means of shedding means, a preferably band-shaped weft material is inserted into an opened loom shed by weft insertion means that are stationary in the warp direction and that define a weft insertion zone, and a fabric edge of the finished woven fabric is moved into a collecting or pick-up position in order to bring the weft material into contact with the fabric edge, it is provided that upper and lower limiting means are moved contrary to the drawing-off direction from a downstream end position into an upstream end position, whereby the limiting means are moved over the woven fabric or the weft material, without clamping or pinching, without active contact with the woven fabric or the last inserted weft material. In the upstream end position, the loom shed that is opening due to effect of the shedding means, is limited or bounded by the limiting means, whereby the last inserted weft material is located between the limiting means, and then the fabric edge newly formed on the rear edge of the last inserted weft material and the limiting means are moved essentially in synchronism with one another back into the initial position or respectively the downstream end position.

Damages of the weft material, which could arise in the prior art while drawing-in the last inserted weft material into the clamping region of the two rollers, are avoided according to the invention, because at least during the motion contrary to the drawing-off direction or during a relative motion between the woven fabric and/or the last inserted weft material and the limiting means, no active clamping and thus no direct contact is provided, but instead the woven fabric or the fabric edge and/or the last inserted weft material are only loosely surrounded by the limiting means. Thus, the movement of the limiting means over the woven fabric and/or over the last inserted weft material is carried out largely contact-free, while in the prior art a fixed or tight tensioning of the weft material or a clamping was provided. The term limiting means or shed limiter device refers to any such means or device by which the spacing distance of the warp material in the shed opening direction can be limited or bounded at least in the area of the fabric edge. Simultaneously, a damaging effect of the warp threads on the last inserted weft material is hindered or prevented by the shed limiter device, i.e. limiting means, which limit or bound the opening of the loom shed prescribed by the shedding means. Because the last inserted weft material is located between the limiting means and a further progression or propagation of the opening of the loom shed is hindered or prevented by the limiting means, therefore the last inserted weft material remains in a straight stretched-out condition and cannot be deflected by the warp threads. In this regard, the limiting means protect the newly inserted weft material against a deformation by the opening loom shed, until it is collected or picked-up out of the weft insertion zone through the contact with the previous fabric edge and is transported away in the direction toward the drawing-off arrangement. A wave-shaped deformation of the weft material that is still located in the weft insertion zone, which deformation hinders or prevents the production of a desired flat woven fabric and additionally causes further damages of the weft material or of the woven fabric, can thus be prevented.

According to an advantageous embodiment of the invention, in this regard the limiting means movement range is embodied differently from the fabric movement range, preferably larger than the fabric movement range. Hereby it is, for example, possible already to position the last inserted weft material completely between the upper and lower limiting means and thus to protect it before it is moved in the drawing-off direction.

It is furthermore especially advantageous if the limiting means are driveable in the warp direction by means of a separate drive independently of the fabric movement means. This makes a high flexibility of the movement sequences or progressions possible, and offers the possibility of supporting the fabric formation, i.e. the "weft beat-up", as well as adjusting the weft density or weft set of the woven fabric by a corresponding control of the movement sequences.

An advantageous further development of the method provides that the limiting means are first moved from their downstream end position into an upstream intermediate position essentially in synchronism with the movement of the fabric edge from the initial position into the pick-up position. Only after the fabric edge has reached the pick-up position, then the limiting means are moved into the upstream end position, whereby the limiting means are moved in the warp direction over the last inserted weft material. Then the fabric edge and the limiting means are moved essentially in synchronism with one another in the drawing-off direction back into the initial position or respectively the downstream end position. Thus, the last inserted weft material, which at first is still located in the weft insertion zone, is only then collected or picked-up, i.e. moved in the drawing-off direction, once it is located completely between the limiting means and thus is protected against deformations and damages. In a correspondingly embodied weaving machine, the weft insertion zone thus lies essentially within the limiting means movement range.

Similarly according to another embodiment of the invention it is possible that the weft insertion position essentially lies outside of the limiting means movement range. In a corresponding method, the limiting means are first moved out of the downstream end position into the upstream end position essentially synchronously with the woven fabric motion from the initial position into the pick-up position. Then the fabric motion back into the initial position is already started, whereby the last inserted weft material is pulled-in between the limiting means. Only after the last inserted weft material is completely pulled-in between the limiting means, then the limiting means are moved synchronously with the fabric edge from their upstream end position back in the drawing-off direction into the downstream end position.

In order to support the fabric formation, that is to say the binding-in of the last inserted weft material with the previous fabric edge, it is further advantageous if the fabric edge is held in a temporary or transitional standstill after it has reached the pick-up position, and only thereafter is moved back into the initial position. In a weaving machine according to an embodiment of the invention, the weft movement means are correspondingly holdable in a temporary or transitional standstill in the pick-up position.

Advantageously, the limiting means can be held in a temporary or transitional standstill in one or more arbitrary positions within the limiting means movement range. For supporting the fabric formation it is advantageous, for example, if the limiting means are holdable in a temporary or transitional standstill in an intermediate position located essentially downstream from the weft insertion position and/or in the upstream end position. In a corresponding method, the limiting means are held in a temporary or transitional standstill in the intermediate position or in the upstream end position, advantageously during the fabric standstill.

Additionally, a further improvement of the fabric formation can be achieved if, after shed closure, the closed or already again opening loom shed is held in a temporary or transitional shed standstill or the movement of the warp material in the shed opening direction is held in a temporary or transitional standstill at least until the limiting means have reached their upstream end position and/or the last inserted weft material has come between the limiting means. In an advantageous embodiment of a weaving machine according to the invention, a temporary shed standstill, that is to say a temporary or transitional standstill of the movement of the warp material in the shed opening direction, is made possible after shed closure. Hereby it is possible to bring the last inserted weft material still in the shed closure, if applicable already slightly bound-in, into the protective zone between the limiting means and thus to protect it from a deflection or a wave-shaped deformation at every point in time. According to an advantageous embodiment of the invention, for this the shedding means include heald shafts with elongated heddle eyelets so that no active interventions in the continuous motion sequence of the shedding means are necessary. In this regard, the heddle eyelets are elongated in such a manner so that a shed standstill arises over at least 1/36 of the duration of one weaving cycle.

According to another advantageous further development of the invention, the weft material remains clamped in clamps on both sides of the warp material after the weft insertion so long until it has completely, i.e. over its entire width up to its rear edge, come between the limiting means. Thereby the weft material can be protected against deformations by the warp material at every point in time.

An advantageous embodiment of the invention provides that the limiting means include two bars or rails extending in the weft direction. These can be embodied as bars or rails that are fixed and stationary relative to one another and thus surround the weft material only loosely at every point in time.

Similarly however, it can also be advantageous if the last inserted weft material is clamped between the limiting means during the movement of the limiting means back into the downstream end position. Ina corresponding weaving machine, the limiting means are embodied as clamping means. For this, the limiting means comprise two bars or rails extending in the weft direction, whereby at least one of the bars or rails is movable in the vertical direction in order to clamp the weft material. Thus, the weft material is positively clamped and protected against deflection and wave formation during the entire woven fabric formation and its transport in the drawing-off direction.

It is furthermore advantageous if the spacing distance of the bars or rails is adjustable, in order to make possible an adjustment or adaptation to the thickness of the material being processed or the arising woven fabric. Thereby at any time it is possible to produce an optimal adjustment with respect to the most effective possible limiting or bounding of the warp threads on the one hand and a protection or careful treatment of the woven fabric or the weft material by avoiding a direct contact as well as a clamping on the other hand. In this regard it is especially advantageous if the vertical spacing distance of the bars is adjustable also during the weaving operation. Hereby an adaptation is possible at any time without interrupting the process. As an example, in a method for producing a woven fabric it is advantageous if the spacing distance of the limiting means is reduced during the movement of the limiting means after reaching the upstream end position. Hereby in a gentle manner an especially good protection of the last inserted weft material can be ensured, whereby no danger of a damage of the goods or woven fabric by a direct clamping contact exists.

According to an especially advantageous embodiment of the invention, furthermore a weaving reed is provided that is moveable in the warp direction between a forward and a rear end position, wherein the forward end position of the weaving reed with respect to the drawing-off direction lies upstream or behind, or just reaches, a rear edge of the last inserted weft material that is located in the weft insertion zone. Through this limited reed movement, after the weft insertion and before or during a woven fabric movement into the pick-up position, a rear edge of the last inserted weft material is oriented or aligned straight in the weft direction, if it takes up a curved path or does not lie straight in the weft direction. Damages of the weft material are nonetheless avoided by the only limited effective or operating range of the reed beat-up.

Furthermore it is advantageous if the function or the motion of the limiting means as well as the correct transport-away of the weft material out of the weft insertion zone is monitored by means of suitable sensors in order to avoid collisions with the weft insertion means and errors or faults in the woven fabric formation.

BRIEF DESCRIPTION OF THE DRAWINGS

Further advantages will be described in connection with the following illustrated example embodiments. It is shown by.

DETAILED DESCRIPTION OF EXAMPLE EMBODIMENTS OF THE INVENTION

Figure 1:
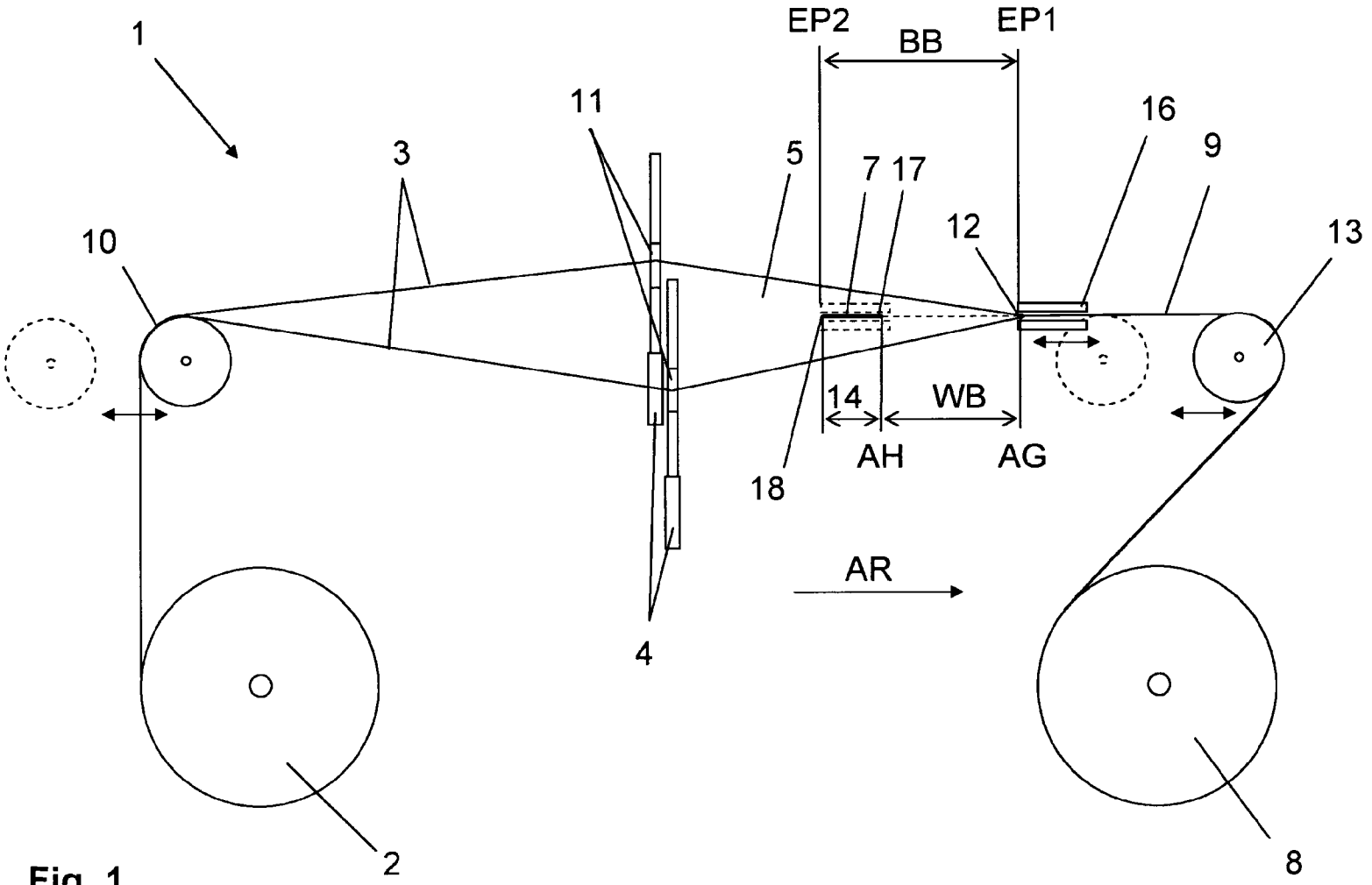
FIG. 1 a schematic illustration of a weaving machine according to the invention with woven fabric movement means and limiting means.

FIG. 1 shows a weaving machine 1 according to the invention in a schematic side view. The weaving machine 1 in a known manner includes a warp beam or roll 2 from which a warp material 3 is provided, shedding means 4 for forming a loom shed 5, as well as weft insertion means 6 (presently not shown, see FIG. 6) for the insertion of a preferably band-shaped weft material 7 into the loom shed 5. The warp material can alternatively be provided from a creel with a plurality of warp spools or bobbins from which the warp material is drawn off. Furthermore, drawing-off or take-off means 8 for drawing off the finished goods or woven fabric 9 in a drawing-off or take-off direction AR (presently symbolized by an arrow) are provided. In a conventional manner the warp material 3 can be embodied thread-shaped, or also band-shaped. In a manner known as such, the warp material 3 is guided from the warp beam 2 over a backrest beam or whip roll 10 through the heddle eyelets 11 of the shedding means 4, which are presently embodied as heald shafts, and which form the loom shed 5 by alternately raising and lowering the warp material 3. The warp material 3 runs together at the binding or interlacing point 12 of the woven fabric, from where the finished goods or woven fabric 9 is delivered over a breast beam 13 to the drawing-off means 8. The weft insertion means 6 are arranged stationarily with respect to the warp direction and define a weft insertion zone 14 of which the width with respect to the warp direction in this regard respectively corresponds to the width of the utilized weft material.

Because band-shaped weft material 7 would be damaged by a typical conventional weft beat-up, it is provided to effectuate a fabric formation by a woven fabric movement. For this, with a closing loom shed 5, the fabric edge 12 is moved by fabric movement means 10, 13 contrary to the drawing-off direction AR in the direction of the weft material 7 still located in the weft insertion zone 14, in order to bind-in the weft material 7 with the woven fabric. The means 10, 13 for woven fabric movement are presently formed by the breast beam 13 and the backrest or whip roll 10, which are moveable synchronously with one another back and forth in the warp direction, as indicated by the dashed-line illustration and the double-headed arrows. The means 10, 13 for woven fabric movement could, however, also be formed by reversible drawing-off means 8 in connection with a reversible drive for the warp beam 2. Furthermore a movement of the fabric edge 12 could also be realized by a superposition of a movement of the breast beam 13 and of the backrest or whip roll 10 on the one hand as well as the drawing-off means 8 on the other hand.

Presently the fabric edge 12 is located in its downstream (with respect to the drawing-off direction AR) initial position AG and is moveable contrary to the drawing-off direction AR into an upstream collecting or pick-up position AH, where it is brought into contact with the respective last inserted weft material 7. After the last inserted weft material 7 is bound-up and bound-off with the goods or woven fabric 9, the fabric movement means 13, 10 are moved in the drawing-off direction back into their initial position illustrated with solid lines, whereby the fabric edge 12 newly formed on the rear edge of the last inserted weft material 7 is brought back into the initial position AG, and the goods or woven fabric 9 is drawn-off in a known manner.

A further problem presented in the processing of band-shaped weft materials 7 is seen in a wave-shaped deformation of the weft material 7 due to the movement of the warp material 3 in connection with an opening loom shed 5. This wave formation not only hinders or prevents the formation of a desired uniform and flat woven fabric 9, but also can lead to problems and damages, especially of the protruding weft material 7, in the further processing or during the fabric drawing-off. The wave-shaped deformation further leads to a retracting or pulling-in of the band-shaped weft material 7 from the two lateral fabric selvedges in the direction toward the woven fabric centerline, so that also the formation of the lateral fabric termination or edge is impaired. According to an embodiment of the present invention, therefore, upper and lower limiting means 16 are provided, between which the warp material or the finished goods or woven fabric 9 is guided to the drawing-off means 8. According to an embodiment of the invention, the limiting means 16 are movable in the warp direction back and forth between an upstream end position EP2 and a downstream end position EP1, and are hereby in the position to protect the last inserted weft material 7 from an undesired deflection due to the warp material 3 and damages, already in the weft insertion zone 14 and during its entire transport-away out of the weft insertion zone 14. Hereby it is especially advantageous that at least the movement of the limiting means 16 contrary to the drawing-off direction AR, thus the collecting or picking-up of the weft material 7, is carried out free of clamping or pinching, that is to say essentially without direct contact with the weft material 7 and the woven fabric 9, so that the danger of damages of the weft material 7 is reduced.

Because the goods movement means 10, 13 and the limiting means 16 are embodied as independent structural assemblies, for example as can be seen from FIG. 1, it is also possible to embody the limiting means movement range, which extends between the upstream and the downstream end positions EP1 and EP2, larger than the fabric movement range WB. Thus the limiting means 16 can be moved directly into the weft insertion zone 14 in order to there collect or pick-up the inserted weft material 7. If furthermore the limiting means 16 are preferably driveable by means of a separate drive 21 (see FIG. 6) independently of the fabric movement means 10, 13, then the movement sequences can be adapted especially flexibly to the respective utilized weft material 7 and further circumstances. Especially, a completely independent temporal control of the movement sequences of the fabric movement means 13 and 10 as well as of the limiting means 16 is possible. Hereby it can be achieved in an advantageous manner, that the fabric edge 12 is securely held and guided by the fabric movement means 13, 10, while simultaneously already the weft material 7 is protected between the upper and lower limiting means 16. Also, a gap formation in the woven fabric can hereby largely be avoided.

An illustration of an example of a method for producing a woven fabric as well as the movement sequence of the limiting means 16 and of the fabric movement means 13, 10 is illustrated in FIGS. 3*a* to 3*e* in a schematic side view.

Figure 3A:
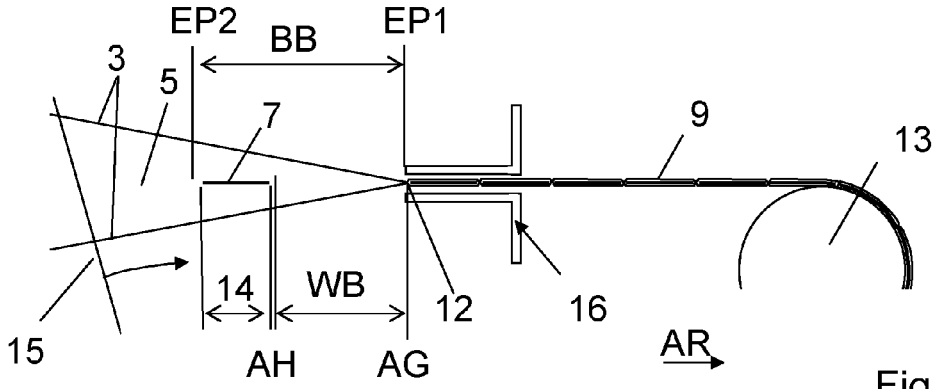
FIG. 3 an illustration of a method for producing a woven fabric according to a first example.

In this regard, FIG. 3*a* shows the situation of the fabric movement means 13 as well as of the limiting means 16 directly after the weft insertion. With respect to the main shaft of the weaving machine 1, a situation at a machine angle of approximately 290° is shown. At this time point the loom shed 5 is just still open or begins to close. The band-shaped weft material 7 has been inserted by weft insertion means 6, for example a gripper, and now is located in the weft insertion zone 14. At this time point, the fabric edge 12 (and correspondingly the fabric movement means 13, 10) is located in the downstream initial position AG, and the limiting means 16 are located in their downstream end position EP1. Furthermore, a weaving reed 15 is shown, of which the function will be explained at a later time.

Figure 3B:
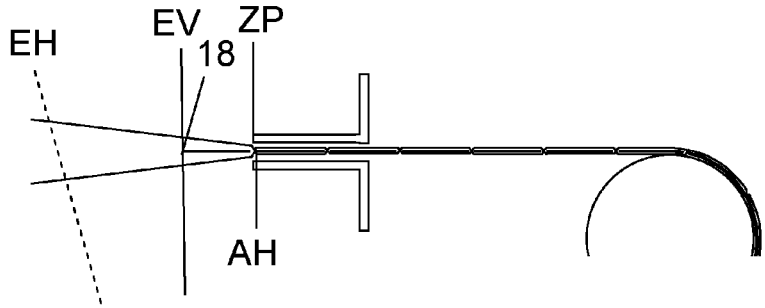

After the completed weft insertion, now essentially simultaneously with one another, both a movement of the goods or fabric 9 or the fabric edge with the fabric movement means 13, 10 as well as a movement of the limiting means 16 begins, until the fabric edge 12 has reached the upstream collecting or pick-up position AH. This situation is illustrated in FIG. 3*b*, and is reached for example at approximately 330° to 340° machine angle. At this time point the loom shed 5 is still approximately one-third open. Furthermore it is visible in FIG. 3*b*, that the fabric edge 12 of the goods or fabric 9 contacts the last inserted weft material 7, as soon as the fabric edge 12 is located in the pick-up position AH, so that the binding-in of the weft material 7 with the finished goods or fabric 9 can take place through the following fabric formation. At this time point the limiting means 16 are located in an intermediate position ZP, which adjoins downstream on the weft insertion zone 14. According to an especially advantageous embodiment, the intermediate position ZP slightly overlaps with the weft insertion zone 14, so that the limiting means 16, as presently illustrated, are located shortly or closely behind the forward edge 17 of the last inserted weft material 7 with respect to the drawing-off direction AR.

Figure 3C:
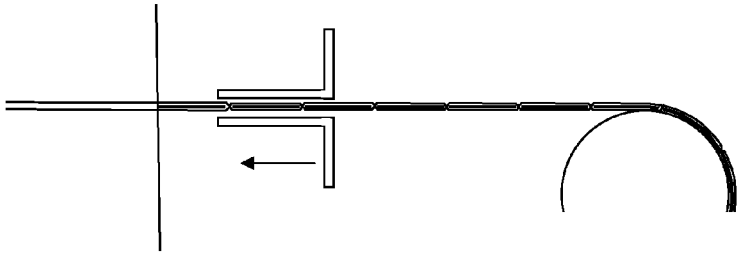

The fabric edge 12 located in the pick-up position AH is now held in a temporary or transitional standstill in order to allow the fabric formation. In this regard it is especially advantageous if, during the fabric standstill, the limiting means 16 are also briefly held in a transitional or temporary standstill in the intermediate position ZP, in order to support the fabric formation. Next, the limiting means 16 are moved out of the intermediate position ZP further contrary to the drawing-off direction AR in the direction toward their upstream end position EP2, as indicated by the arrow in FIG. 3*c*. In this regard, FIG. 3*c* shows the situation shortly after the closing of the loom shed 5, which takes place at approximately 350° machine angle.

Figure 3D:
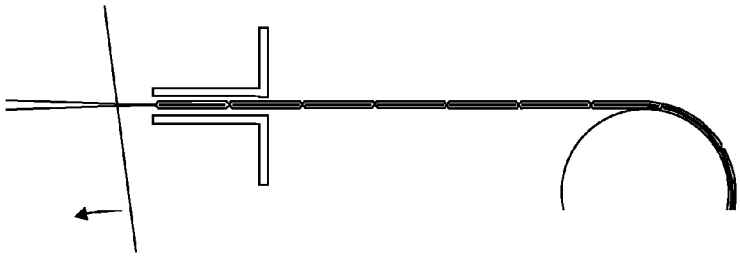

In FIG. 3*d*, the limiting means 16 have finally reached their upstream end position EP2, in which the last inserted weft material 7 is located completely, that is to say over its entire width, between the limiting means 16. Thus, the weft insertion zone 14 lies essentially within the limiting means movement range BB. After the limiting means 16 have reached their upstream end position EP2, the loom shed 5 begins to open again, whereby the weft material 7, which is now located completely between the limiting means 16, is protected against undesired deflections and damages by the warp material 3. The limiting means 16 have reached their upstream end position EP2 at approximately 370° or respectively 10° machine angle.

According to the present example, the opening of the loom shed 5 is delayed after reaching the shed closure (see FIG. 3*c*), in that the closed loom shed 5 is held in a transitional or temporary shed standstill, until the limiting means 16 have reached their upstream end position EP2. Undesired influences of the weft material 7 by the warp material 3 can hereby be avoided in an advantageous manner already at a time point at which the weft material 7 is not yet located completely in the protective zone between the limiting means 16.

Figure 3E:
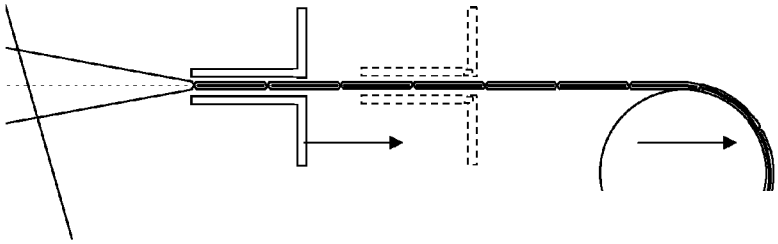

After the limiting means 16 have reached their upstream end position EP2, now again essentially simultaneously with one another, there begins both the movement of the fabric edge 12 with the goods or fabric 9 in the drawing-off direction AR back to the initial position AG as well as the movement of the limiting means 16 back into the downstream end position EP1, which is illustrated with dashed lines in FIG. 3*e*. In this regard, FIG. 3*e* shows the situation shortly after beginning the movement back into the initial position AG or the end position EP1, which begins at approximately 20° machine angle.

After the movement of the fabric edge 12 and of the limiting means 16 in the drawing-off direction AR is completed and a drawing-off of the woven fabric 9 has been carried out, the movement or motion cycle is completed, and begins again anew with the insertion of the next weft material 7. The previous last inserted weft material 7 is still located completely between the limiting means 16 and now forms the new fabric edge 12.

In order to reach the transitional or temporary shed standstill in the shed closure as described in connection with FIG. 3*c*, according to the present example, heald frames or shafts, or shedding means 4, with enlarged heddle eyelets 11 are provided as schematically indicated in FIG. 1. Thereby typical conventional shedding means 4 can be used, whereby the weaving machine 1 or a drive of the shedding means 4 can continue to run on continuously. Similarly it is also possible, however, to realize the transitional or temporary standstill in the shed closure by a special cam disc drive of the held frames or shafts 4 or other specially embodied shedding means 4. A shed standstill over an interval of at least 10° machine angle, preferably between 20° and 50° machine angle, has shown itself to be especially advantageous for the movement progression or sequence and for avoiding a wave-shaped deformation of the weft material 7. Hereby the weft material 7 can come between the limiting means 16 over its entire width exactly in the shed closure.

As already described, the fabric formation through the fabric movement as well as the shed limiting can be achieved in an especially gentle and protective manner, because no clamping or pinching and thus no direct contact takes place between the fabric 9 or the weft material 7 and the limiting means 16 during the relative movement.

In order to hold the weft material in a straight and extended or stretched-out condition, and to protect it against deformations in the horizontal direction as well as a retraction thereof in the direction toward the woven fabric centerline, it can additionally still be provided, to clamp the weft material 7 in the limiting means 16 during the transport-away out of the weft insertion zone 14. For this, the limiting means 16 are embodied as clamping means. Such a method is illustrated in FIG. 4. Because the method of FIG. 4 essentially corresponds with that of FIG. 3, only the differences relating to the additional clamping will be described in the following.

Figure 4A:
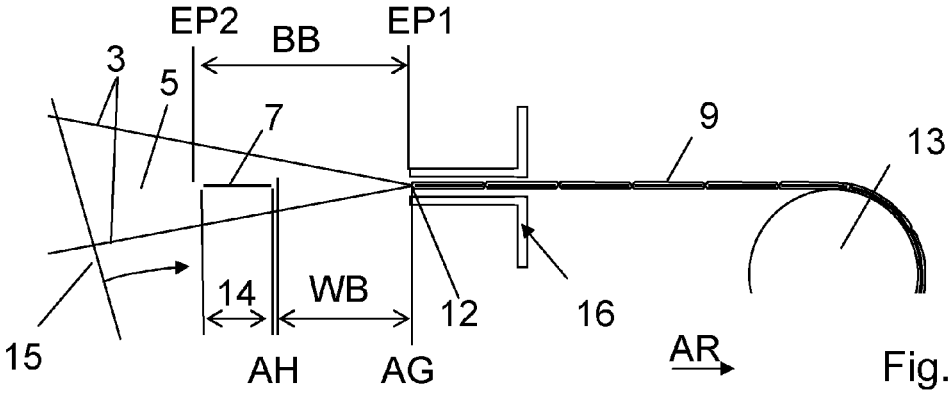
FIG. 4 an illustration of a variant of the method of FIG. 3 with a clamping of the goods or woven fabric.
Figure 4B:
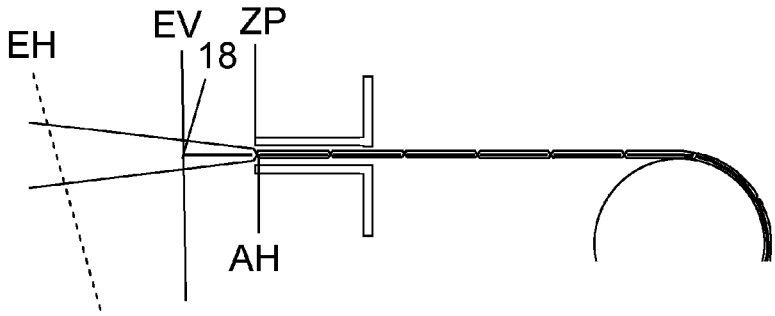
Figure 4C:
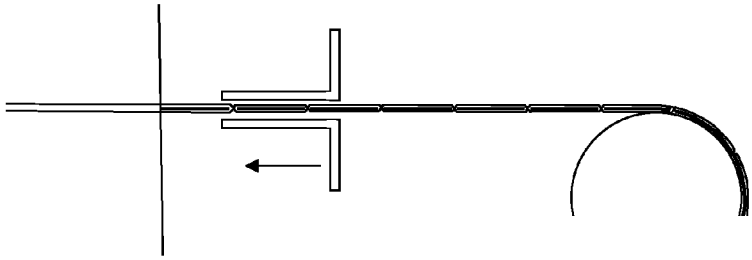
Figure 4D:
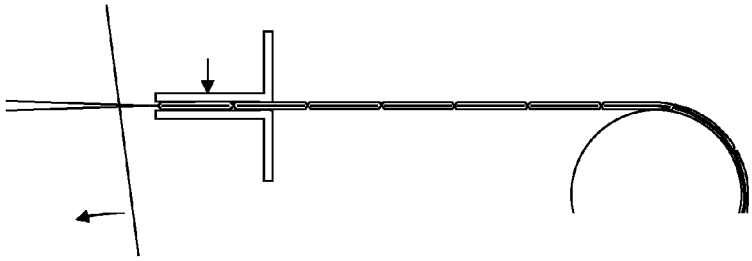
Figure 4E:
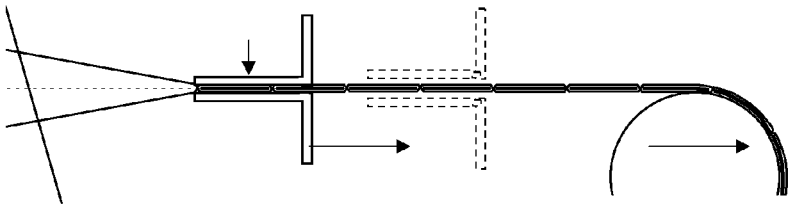

In this regard it can be seen in FIGS. 4*d* and 4*e*, that the upper limiting means 16 can correspondingly be impinged or acted on, whereby the clamping sets in, as soon as the limiting means 16 have reached the rear edge 18 of the last inserted weft material 7 (FIG. 4*d*). The clamping of the weft material is symbolized by an arrow. After reaching the downstream end position EP1 of the limiting means 16, at the latest however before the renewed movement of the limiting means 16 contrary to the drawing-off direction AR, the clamping is finally again released.

FIG. 5 shows a different example of a method, whereby the weft insertion zone 14 is located essentially outside of the limiting means movement range BB, in contrast to the illustration shown in FIG. 3. Thus the upstream end position EP2 is located somewhat farther downstream or somewhat farther forward with respect to the drawing-off direction AR, in comparison to the end position EP2 of FIG. 3. The method progression or sequence is similar to that described in FIG. 3, so that merely the differences relative to the above described method progression or sequence will be described in the following.

Figure 5A:
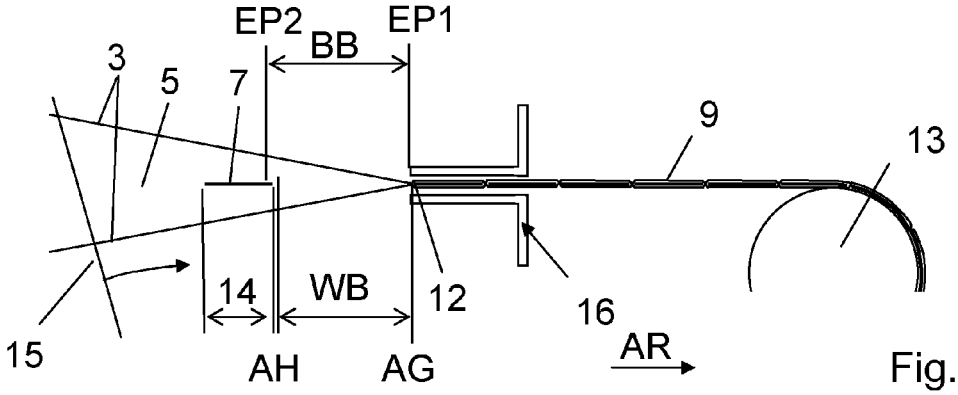
FIG. 5 an illustration of a method according to an alternative example.
Figure 5B:
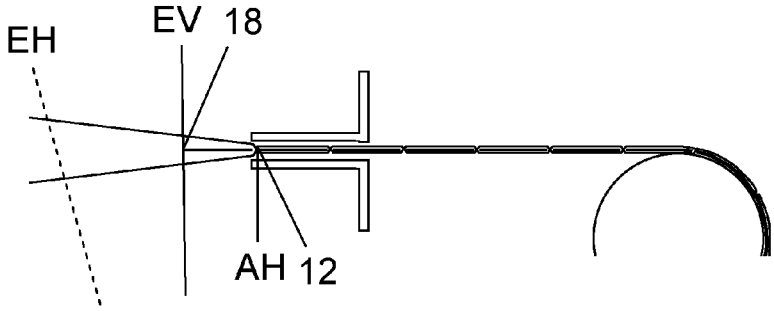

Similarly as described with respect to FIGS. 3*a* and 3*b*, after the weft insertion (FIG. 5*a*) an essentially synchronous movement of the fabric edge 12 and of the limiting means 16 takes place, until the fabric edge 12 has reached the pick-up position AH (FIG. 5*b*). At the same time the limiting means 16 come into their upstream end position EP2, so that according to this example, the fabric movement range WB and the limiting means movement range BB are essentially the same size. Also here it can be advantageous if the fabric edge 12 is held in a transitional or temporary standstill in the pick-up position AH, in order to improve the binding-in of the weft material 7 and the fabric formation.

Figure 5C:
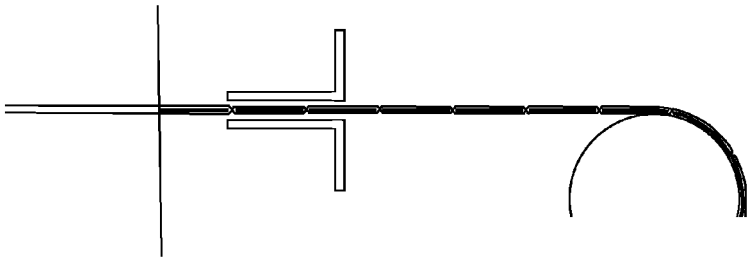
Figure 5D:
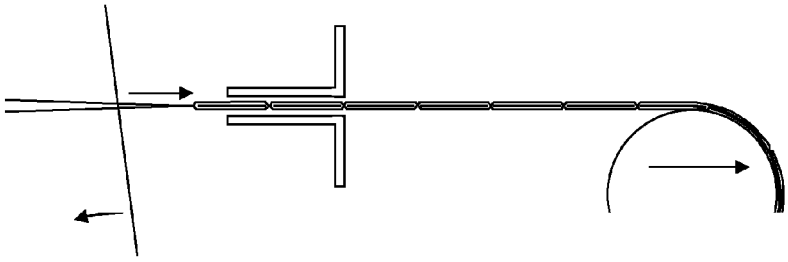
Figure 5E:
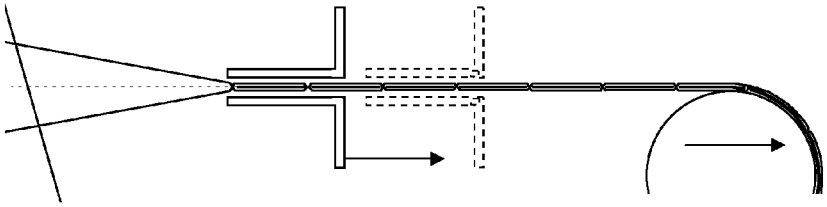

After the shed closure and the completed binding-in of the last inserted weft material 7, which are illustrated in FIG. 5*c*, the limiting means 16 are held in a transitional or temporary standstill in their upstream end position EP2, and the fabric movement in the drawing-off direction AR back into the initial position AG is started. Hereby the last inserted weft material 7 is pulled-in between the stationary limiting means 16, as illustrated by the arrow in FIG. 5*d*. Meanwhile, the loom shed 5 begins to open again. It is thus especially advantageous also in this example of a method, to provide a shed standstill in the shed closure over a certain determined interval, in order to protect the weft material 7 from the opening loom shed 5, already before the complete pulling-in of the weft material 7 into the protective zone between the limiting means 16.

After the weft material is pulled-in over its entire width between the limiting means 16, and the limiting means 16 thus are located shortly or closely behind the rear edge 18 of the weft material 7 (FIG. 5*e*), the movement of the limiting means 16 back into its downstream end position EP1 sets in, whereby this preferably occurs synchronously with the fabric movement. If applicable in this regard once again a clamping of the weft material 7 may be provided, similarly as in the embodiment illustrated in FIG. 4. After the limiting means 16 have reached their downstream end position EP1 and the fabric movement means 13 have reached their initial position AG and the goods or fabric has been drawn-off, once again the movement cycle is completed and the loom shed 5 is opened for the next weft insertion.

Figure 2:
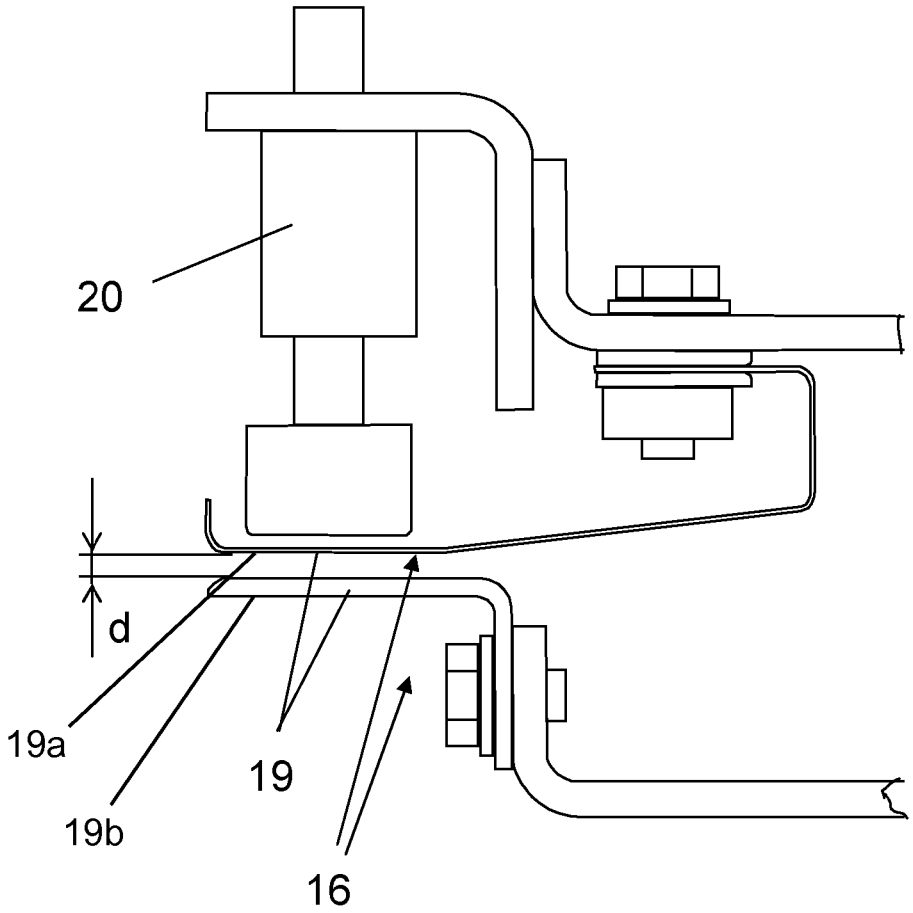
FIG. 2 a detail illustration of limiting means, which are embodied as clamping means.

FIG. 2 shows a detail illustration of limiting means 16, which are embodied as clamping means. In this regard, the limiting means 16 encompass respectively two bars or rails 19 that extend in the weft direction, whereby the upper bar 19*a* is embodied as a spring plate or sheet of spring metal and can be impinged or acted on by an actuator 20. Depending on the embodiment of the actuator 20, it is hereby possible in a advantageous manner, to freely adjust the time point of the clamping and hereby to configure the motion sequences especially flexibly. In comparison, the lower or bottom bar 19*b* is embodied as a fixed stationary bar 19. Similarly it is naturally also conceivable to impinge or act on both bars 19*a* and 19*b* by means of corresponding actuators 20.

According to a variant that is not separately illustrated it can further be provided that a spacing distance d of the two bars or rails is embodied to be adjustable by means of an actuator 20, for example by means of a servomotor. Hereby it is possible to adjust the spacing distance d between the two bars 19 in a targeted manner also during the process, and thereby to carry out an adaptation to the utilized weft material 7 or the warp material 3 and the conditions in the weaving process. Similarly it is naturally also conceivable to provide an adjustment of the spacing distance d only manually, for example by means of a spindle or spacer pieces. Such an adjustment of the spacing distance d is of course also useable and advantageous with fixed stationary bars 19. In order to minimize the friction of possibly arising contacts between the bars 19 and the weft material 7, and to prevent damages, furthermore the inner sides of the bars 19 can be provided with a low-friction surface.

Figure 6:
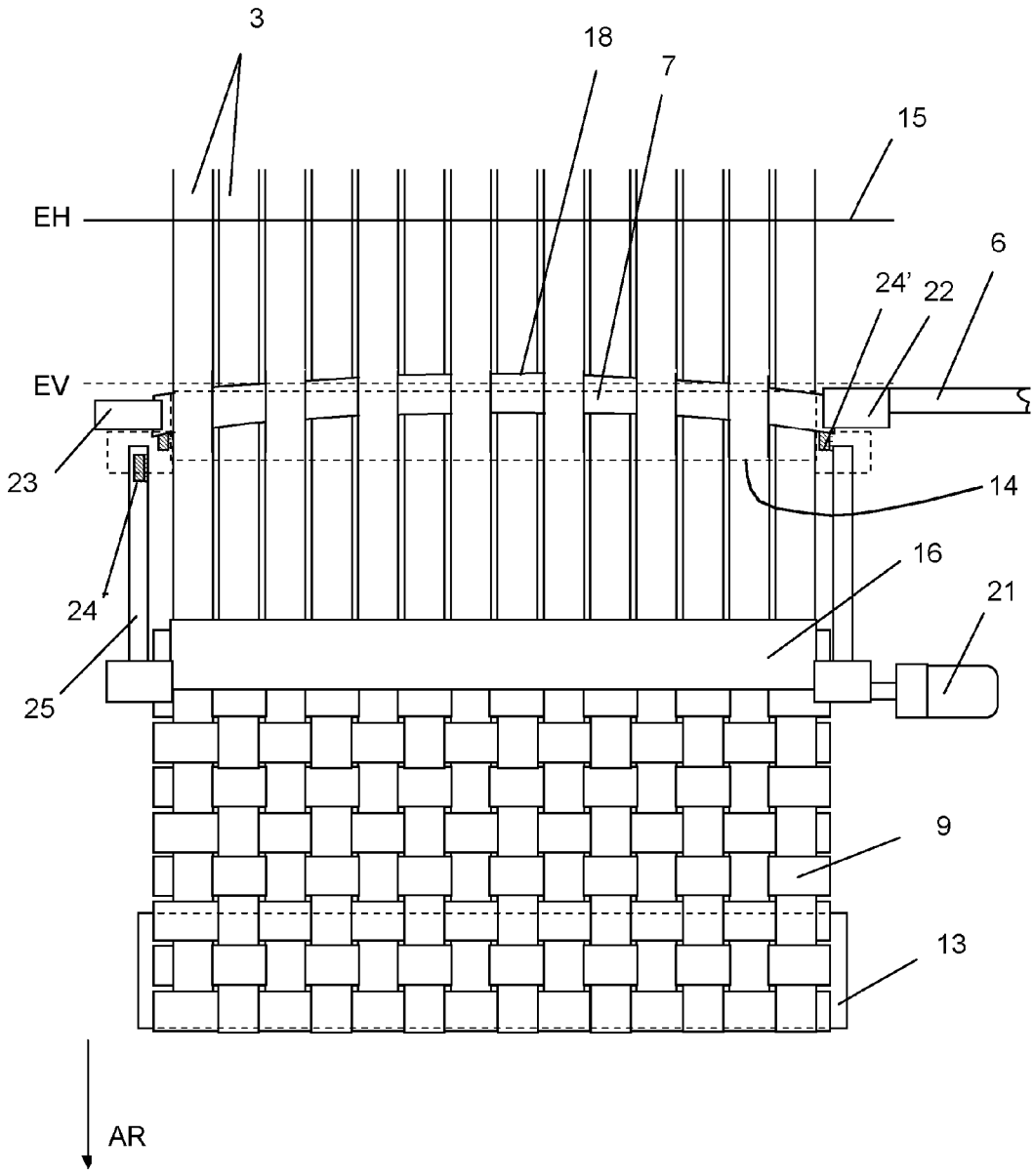
FIG. 6 a further illustration of a method according to another example as well as a weaving machine according to the invention in a schematic top plan view.

FIG. 6 finally shows a schematic top plan view onto a weaving machine 1 whereby essentially the area from the weft insertion zone 14 to the breast beam or roll 13 is illustrated. Furthermore the limiting means 16 are recognizable, which are moveable in a linear guide 25 by means of a suitable drive 21 in the warp direction. If the drive of the limiting means 16, as here illustrated, is achieved by means of a separate servomotor 21, then the movement sequences can be especially flexibly configured and for example adapted to the width of the utilized weft material 7 as well as the movement of the fabric movement means 10, 13. Thus, for example, the movement of the fabric movement means 10, 13 and of the limiting means 16 in the drawing-off direction can occur completely synchronously, in order to protect the last inserted weft material 7 during the entire transport-away out of the weft insertion zone 14. Hereby relative movements between the limiting means 16 and the goods or fabric 9 or the last inserted weft material 7 can be completely avoided and thus an especially gentle or protective transport-away of the last inserted weft material 7 can be ensured. Similarly, however, the movement of the limiting means and of the fabric movement means 10, 13 can also occur asynchronously in order to hereby selectively achieve a certain draft, delay or offset in the woven fabric 9, or to push the woven fabric more closely together and hereby achieve a greater weft density or weft set.

As is further shown in FIG. 6, an arc-shaped orientation of the weft material 7 in the weft insertion zone 14 can arise due to the contacting of the weft material 7 on the warp material 3 as well as due to the fabric movement contrary to the drawing-off direction AR. This leads not only to undesired gaps and a non-uniform image or appearance of the goods, but can also hinder or prevent the uniform formation of the subsequent loom shed. In the weaving machine 1 according to an embodiment of the invention, therefore, furthermore a weaving reed 15 can be provided, which, however, does not carry out a typical conventional weft beat-up, but instead can only be guidedly moved close to the weft insertion zone 14 in order to straightly orient the rear edge 18 of the weft material 7.

The stroke or travel of the weaving reed 15 is limited relative to the typical conventional arrangements of the prior art. The weaving reed 15 is movable between a forward end position EV, which is forward with respect to the drawing-off direction AR and which is illustrated with dashed lines, and a rear end position EH which is illustrated with solid lines. In this regard, the forward end position EV lies behind or upstream from the weft insertion zone 14 or behind the rear edge 18 of a weft material 7 that is oriented straight in the weft insertion zone 14, or just reaches the latter. Hereby it can be achieved that only the rear edge 18 of a weft material 7 lying in an arc-shape is straightened, whereby due to the limited stroke travel no damages of the weft material 7 are to be expected. On the other hand, if the weft material 7 lies oriented straight and extended or stretched-out in the weft insertion zone 14, then it is not influenced by the reed movement. Because the weft material 7 comes into contact with the weaving reed 15 only when it has an undesired arc-shaped extension or shape, hereby the danger of damages can further be reduced. By the limited reed beat-up it can be ensured that the weft material 7 takes on a straight shape or extension in every case, and a uniform shed formation takes place.

The movement of the weaving reed 15 in the movement cycle of the limiting means 16 and of the fabric movement means 10 and 13 is similarly also illustrated in FIGS. 3, 4 and 5. As can be seen from FIGS. 3*a*, 4*a* and 5*a*, the movement of the weaving reed 15 out of its rear end position EH in the direction toward its forward end position EV, which is illustrated in FIGS. 3*b*/4*b*/5*b* and 3*c*/4*c*/5*c*, and which essentially lies in the area of the rear edge 18 of the last inserted weft material 7, begins directly after the weft insertion. Already during the fabric movement and the limiting means movement contrary to the drawing-off direction AR, the weaving reed lies in or adjoining its forward end position EV and thus hinders or prevents a shifting displacement of the weft material 7 out of the weft insertion zone 14. After shed closure (FIGS. 3*c*/4*c*/5*c*) and the completed fabric formation, the weaving reed 15 again moves back into its rear end position EH.

Further illustrated in FIG. 6 are the weft insertion means 6, presently a gripper with a gripper clamp 22, as well as a presenting or reaching-in clamp 23 on the opposite side on which the respective weft material 7 to be inserted is prepared. In order to further hinder or prevent the arc-shaped orientation or alignment of the weft material 7 after the weft insertion as well as the formation of a wave-shaped pattern or shape due to the moving warp material 3, according to an advantageous example it is provided that after the weft insertion the inserted weft material 7 remains clamped in the clamps 22 and 23 until it is located completely in the protective zone between the upper and lower limiting means 16. Thus, the weft material 7 remains under tension so long until the fabric movement contrary to the drawing-off direction AR is completed and the limiting of the loom shed 5 by the limiting means 16 comes into effect. Thus, the weft material 7 is protected and guided during the entire woven fabric formation process, so that an especially uniform woven fabric 9 can be achieved.

If the limiting means 16 are embodied as clamping means as described in FIG. 4, then the weft material 7 can be clamped during the entire woven fabric formation process and its transport-away out of the weft insertion zone 14, and hereby can be protected against deformations. Hereby, after the limiting means 16 have moved over the last inserted weft material 7, the weft material 7 is clamped in the limiting means as illustrated in FIG. 4*d*. Only thereafter the clamps 22 and 23 are released and the fabric movement as well as the movement of the limiting means 16 in the drawing-off direction AR is started.

As further shown in FIG. 6, it is advantageous if the movement of the limiting means 16 as well as the transport-away of the weft material 7 out of the weft insertion zone 14 is monitored by suitable sensors 24, 24'. Thus, for example, at least one sensor 24 can be arranged within the limiting means movement range BB, which sensor monitors the upstream end position EP2 of the limiting means 16 and registers the moving-away of the limiting means 16 out of the end position EP2. If the sensor 24 cannot detect a movement of the limiting means 16 out of their end position EP2, then the weaving machine 1 is immediately stopped in order to avoid collisions with the weft insertion means 6. Similarly further sensors 24 can be provided in the limiting means movement range BB or the downstream end position EP1 of the limiting means 16 can be monitored, in order to controlledly advance toward a corresponding release of the weft insertion means 6. Furthermore additional sensors 24' can be provided, for example within the weft insertion zone 14 in the lateral areas, in order to monitor the correct transport-away of the weft material 7 out of the weft insertion zone 14.

An especially gentle or protective fabric formation or binding-in of the weft material 7 can be achieved by the moveable limiting means 16 according to the invention, which are moveable without a direct contact of the woven fabric 9 or of the weft material 7. Damages of the weft material 7 or of the woven fabric 9 by friction on the limiting means 16 are avoided, just like the problems of the arc-shaped binding-in and the wave formation that exist in the prior art. In this regard, it is especially advantageous that the weft material 7 is located in a protected area between the upper and lower limiting means 16 during the entire transport-away out of the weft insertion zone 14. Because the fabric movement means 13 as well as the limiting means 16 are embodied as separate structural units, the woven fabric 9 remains guided by the fabric movement means 10, 13 even during the movement of the limiting means 16 over the weft material 7, so that the danger of an undesired gap formation between the woven fabric 9 and the new weft material 7 to be bound-in can be avoided.

REFERENCE CHARACTER LIST

1 weaving machine
2 warp beam or roll
3 warp material
4 shedding means
5 loom shed
6 weft insertion means
7 weft material
8 drawing-off means
9 goods, woven fabric
10 means for fabric movement, backrest beam or whip roll
11 heddle eyelets
12 fabric edge, binding or interlacing point
13 means for fabric movement, breast beam or roll
14 weft insertion zone
15 weaving reed
16 limiting means
17 forward edge of the weft material
18 rear edge of the weft material
19 bars or rails
20 actuator
21 drive
22 gripper clamp
23 presenting or reaching-in clamp
24, 24' sensor
25 linear guide
AR drawing-off direction
WB goods movement range
BB limiting means movement range
AG downstream initial position
AH upstream collecting or pick-up position
EP1 downstream end position
EP2 upstream end position
EV forward end position of the weaving reed
EH rear end position of the weaving reed
d spacing distance

The invention claimed is:

1. A weaving machine for producing a woven fabric, comprising:

a shedding device configured and arranged to alternately open and close a loom shed of warp material thereby forming an interlacing point at which a respective upper warp sheet and a respective lower warp sheet of said warp material of said loom shed cross one another;

a weft insertion device configured and arranged to insert a band-shaped or tape-shaped weft material into a weft insertion zone in said loom shed across said warp material;

a fabric movement arrangement configured and arranged to move said warp material back and forth in an upstream direction and a downstream direction, wherein moving said warp material in said upstream direction moves said interlacing point toward said weft material in said weft insertion zone; and a shed limiter device comprising an upper limiter member positioned above said warp material and a lower limiter member positioned below said warp material, wherein said shed limiter device is configured and arranged to limit an opening of said loom shed of said warp material and is movable back and forth in said upstream direction and said downstream direction, and wherein said shed limiter device is configured and arranged to move relative to said warp material and said weft material without tightly clamping or tightly pinching said warp material and said weft material at least when said shed limiter device moves in said upstream direction.

2. The weaving machine according to claim 1, wherein said upper limiter member comprises an upper bar extending parallel to said weft material across said warp material, and said lower limiter member comprises a lower bar extending parallel to said weft material across said warp material.

3. The weaving machine according to claim 1, wherein said upper limiter member and said lower limiter member are fixed relative to one another with a fixed spacing distance therebetween.

4. The weaving machine according to claim 1, wherein at least one of said limiter members is adjustable relative to another of said limiter members to establish an adjustable spacing distance therebetween.

5. The weaving machine according to claim 1, wherein said shed limiter device further comprises a clamping actuator operatively connected to at least one of said limiter members, and configured and arranged to move said one of said limiter members toward and away from another of said limiter members to selectively clampingly engage and release said warp material and said weft material between said limiter members.

6. The weaving machine according to claim 1, further comprising a weaving reed that is movable in said upstream direction maximally to an upstream end position and in said downstream direction maximally to a downstream end position, wherein said downstream end position is located upstream from or bordering on an upstream side of said weft insertion zone.

7. The weaving machine according to claim 1, further comprising a sensor configured and arranged to detect a position of said shed limiter device with respect to said upstream and downstream directions.

8. The weaving machine according to claim 1, further comprising a sensor configured and arranged to detect a position of a last inserted strand of said weft material.

9. The weaving machine according to claim 1, wherein said shedding device comprises heald shafts with elongated heddle eyelets that have an eyelet length sufficient so as to enable a shed standstill during at least 1;36 of a complete weaving cycle.

10. The weaving machine according to claim 1, wherein said weft insertion zone and said weft insertion device are each stationarily located with respect to said upstream direction and said downstream direction, said fabric movement arrangement is configured and arranged to move said interlacing point in said downstream direction maximally to a downstream position and to move said interlacing point in said upstream direction maximally to an upstream position, said downstream position is spaced downstream away from said weft insertion zone, and said upstream position borders on or is adjacent to or is within said weft insertion zone so that said interlacing point brought into said upstream position borders on or is adjacent to a respective last inserted strand of said weft material.

11. The weaving machine according to claim 1, wherein said shed limiter device is configured and arranged to move in said upstream direction and said downstream direction within a first movement range, said fabric movement arrangement is configured and arranged to move said warp material in said upstream direction and said downstream direction within a second movement range, and said second movement range differs from said first movement range.

12. The weaving machine according to claim 11, wherein said first movement range is larger than said second movement range.

13. The weaving machine according to claim 1, further comprising a first drive operatively connected to drive said shed limiter device to move in said upstream direction and said downstream direction, and a second drive operatively connected to drive said fabric movement arrangement to move said warp material in said upstream direction and said downstream direction, wherein said first drive and said second drive are separate and independent from one another.

14. The weaving machine according to claim 1, wherein a movement range of said shed limiter device in said upstream direction and said downstream direction encompasses or includes said weft insertion zone therein.

15. The weaving machine according to claim 1, wherein said fabric movement arrangement is configured and arranged to stop and hold said warp material in a temporary standstill with said interlacing point at a position bordering on or adjacent to or within said weft insertion zone.

16. The weaving machine according to claim 1, wherein said shed limiter device is configured and arranged to be stoppable and holdable in a temporary standstill at at least one specified position of a movement range of said shed limiter device in said upstream direction and said downstream direction.

17. The weaving machine according to claim 16, wherein said specified position is an intermediate position within said movement range between end limits of said movement range.

18. The weaving machine according to claim 16, wherein said specified position is an upstream end limit of said movement range.

19. The weaving machine according to claim 1, wherein said shedding device is configured and arranged to stop and hold said loom shed at a temporary shed standstill after closing said loom shed during a weaving operation.

20. A weaving machine for producing a woven fabric with shedding means for alternately raising and lowering warp material for forming a loom shed, with weft insertion means, which are arranged stationarily in the warp direction in a weft insertion zone, and which are for inserting a band-shaped weft material into the loom shed, with drawing-off means for drawing off the finished woven fabric in a drawing-off direction, as well as with means for the fabric movement in the warp direction, by means of which the fabric edge is movable back and forth in a goods movement range between a downstream initial position and an upstream pick-up position, in order to bring the respective last inserted weft material into contact with the fabric edge in the pick-up position, characterized in that furthermore upper and lower limiting means are provided, which limit the opening of the loom shed, in that the limiting means are movable back and forth in the warp direction within a limiting means movement range between an upstream end position and a downstream end position, and in that the limiting means are movable in a manner free of clamping or pinching at least contrary to the drawing-off direction over the woven fabric and the last inserted weft material.

* * * * *

UNITED STATES PATENT AND TRADEMARK OFFICE

CERTIFICATE OF CORRECTION

PATENT NO. : 8,939,179 B2
APPLICATION NO. : 13/980120
DATED : January 27, 2015
INVENTOR(S) : Janicijevic et al.

It is certified that error appears in the above-identified patent and that said Letters Patent is hereby corrected as shown below:

Title page,
Item [57], ABSTRACT,
Line 6, after "direction," insert --and a--;

In the Specification,
Column 5,
Line 15, after "position.", "Ina" should read --In a--;

In the Claims,
Column 15,
Line 2, Claim 9, after "least", replace "/1;36" by --1/36--.

Signed and Sealed this
Eighth Day of September, 2015

Michelle K. Lee

Michelle K. Lee
*Director of the United States Patent and Trademark Office*